US006418623B1

(12) United States Patent
Marcarelli

(10) Patent No.: US 6,418,623 B1
(45) Date of Patent: Jul. 16, 2002

(54) DUAL-BLADE RAZOR HEAD WITH ADJUSTABLE SPACER

(76) Inventor: Michael A. Marcarelli, 559 Adams St., Apt. #1, Dorchester, MA (US) 02122

( * ) Notice: Subject to any disclaimer, the term of this patent is extended or adjusted under 35 U.S.C. 154(b) by 0 days.

(21) Appl. No.: 09/542,648

(22) Filed: Apr. 3, 2000

Related U.S. Application Data

(60) Provisional application No. 60/144,115, filed on Jul. 16, 1999.

(51) Int. Cl.[7] ..... B26B 21/14

(52) U.S. Cl. ..... 30/50; 30/34.1; 30/526; 30/346.57

(58) Field of Search ..... 30/50, 34.1, 526, 30/346.57

(56) References Cited

U.S. PATENT DOCUMENTS

| | | | | |
|---|---|---|---|---|
| 2,156,559 A | | 5/1939 | Young et al. | 30/51 |
| 2,587,964 A | | 3/1952 | Burns | 30/30 |
| 4,285,124 A | | 8/1981 | Diakonov | 30/34.1 |
| 4,443,939 A | | 4/1984 | Motta et al. | 30/49 |
| 4,461,078 A | | 7/1984 | Carreker | 30/47 |
| 4,501,066 A | | 2/1985 | Sceberras | 30/50 |
| 4,782,590 A | | 11/1988 | Pope | 30/50 |
| 5,687,485 A | | 11/1997 | Shurtleff et al. | 30/526 |
| 5,778,535 A | | 7/1998 | Ledesma | 30/50 |
| D403,113 S | | 12/1998 | Kohring et al. | D28/48 |
| 6,052,905 A | * | 4/2000 | Branchinelli et al. | 30/50 |
| 6,125,857 A | * | 10/2000 | Silber | 30/50 X |
| 6,141,875 A | * | 11/2000 | Andrews | 30/50 |

* cited by examiner

*Primary Examiner*—Douglas D. Watts
(74) *Attorney, Agent, or Firm*—Mills & Onello LLP

(57) ABSTRACT

A razor head assembly is adapted for grooming of a narrow beard line of uniform width. The assembly includes a razor head supportable of razor blade assemblies. First and second razor blade assemblies are mountable to the head. The razor blade assemblies each include a razor blade having a longitudinal axis. The blade assemblies are mountable such that their longitudinal axes are substantially aligned and such that they are laterally spaced apart by a gap, either fixed, or adjustable, in width. In this manner, a beard of a uniform width can be groomed, the width being defined by the size of the gap.

20 Claims, 8 Drawing Sheets

DUAL-BLADE RAZOR HEAD WITH ADJUSTABLE SPACER

RELATED APPLICATIONS

This application claims the benefit of United States Provisional Application, Ser. No. 60/144,115, filed Jul. 16, 1999, the contents of which are incorporated herein by reference, in their entirety.

BACKGROUND OF THE INVENTION

In recent years, extremely narrow beards, moustaches, and goatees of uniform width have become popular. An exemplary narrow beard is illustrated in FIG. 2B, as compared to the standard-width non-uniform beard of FIG. 2A. Such narrow beards are commonly referred to as "tight" beards. By conventional means, trimming and shaving of a tight beard is accomplished using a standard razor or straight razor; by trimming inner and outer edges of each portion of the beard with an edge of the razor. This proves to be a time-consuming process which often times leads to inconsistent grooming.

SUMMARY OF THE INVENTION

The present invention is directed to a razor head that includes first and second blade assemblies spaced apart by a lateral gap. In this manner, a user directs the blades simultaneously on each side of a narrow beard or moustache line, creating the "tight" look in a time-efficient, accurate, and safe manner.

A first object of the present invention is to provide a facial hair (beard and trim-type goatee) adjustable wet razor shaving system to be employed to trim facial hair to a uniform width quickly and effectively according to the needs of a user.

A second object of the present invention is to allow a user to groom facial hair to a selectable desired uniform width by providing an adjustable-width razor.

In order to achieve the above objects, the present invention is directed to a razor head assembly comprising a razor head and first and second razor blade assemblies. The razor head is supportable of the razor blade assemblies. The first and second razor blade assemblies are mountable to the head. Each razor blade assembly includes a razor blade having a longitudinal axis along its length. The blade assemblies are mountable such that their longitudinal axes are substantially aligned and such that their respective razor blades are laterally spaced apart by a gap.

In a preferred embodiment, at least one of the first and second blade assemblies is independently positionable relative to the head along the longitudinal axis for adjusting the width of the gap. At least one of the first and second blade assemblies is preferably slidable relative to the head in a direction along the longitudinal axis. The razor head assembly may further include a tab for discrete positioning of the slidable assembly. The tab may comprise a spring-loaded arm mounted to the slidable assembly and adapted to interface with recesses on the head for discrete positioning of the assembly.

In alternative embodiments, the first and second razor blade assemblies may be mounted in a fixed position relative to the head. The head may be mounted to a handle at a proximal end of the handle, for example in a pivoting relationship, the handle further including an aperture at a distal end adapted for hanging the assembly. Each razor head assembly may comprise a single razor blade, or multiple razor blades laterally spaced apart and parallel to each other according to conventional multiple razor configurations.

In a second embodiment, the present invention is directed to a blade for an electric shaver, the blade being attachable to an motorized arm for driving the blade. The blade includes a row of teeth extending in a transverse direction, the row being apportioned into first and second teeth portions, spaced apart by a gap. In this manner, the present invention is equally applicable to electric shavers.

BRIEF DESCRIPTION OF THE DRAWINGS

The foregoing and other objects, features and advantages of the invention will be apparent from the more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF PREFERRED EMBODIMENTS

Figure 1:
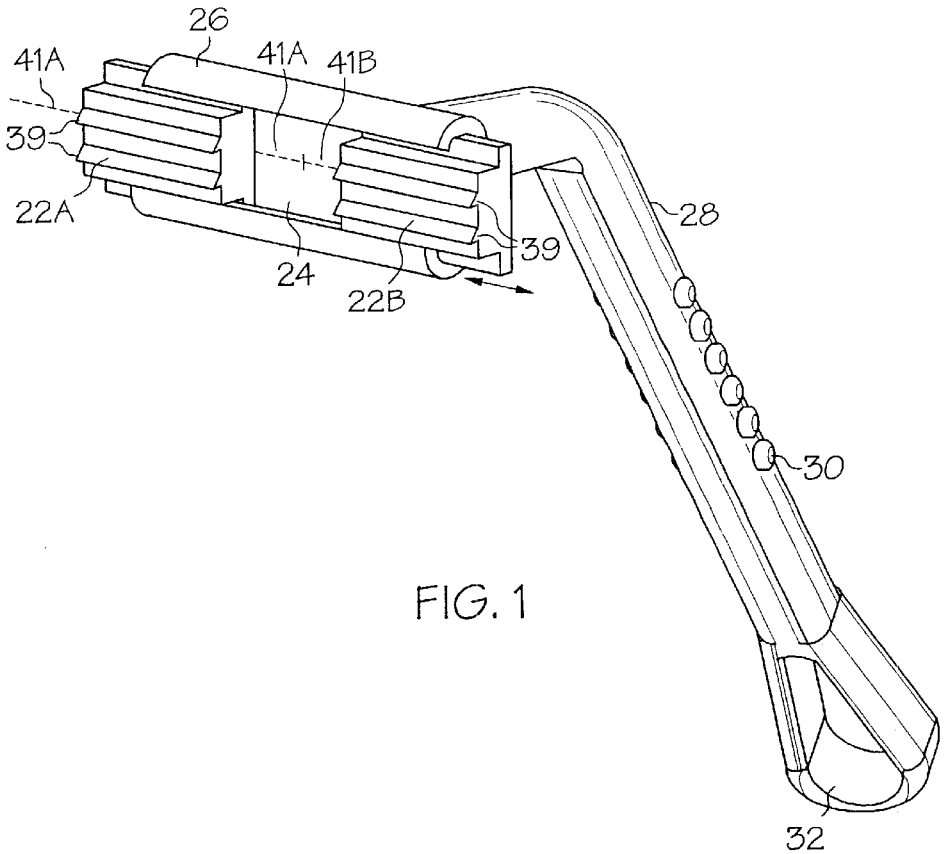
FIG. 1 is a perspective view of a razor head assembly in accordance with a preferred embodiment in the present invention.
Figure 2A:
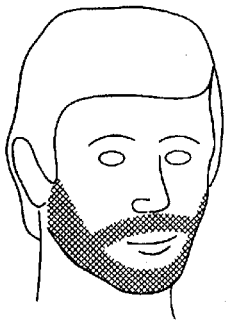
FIGS. 2A and 2B illustrate a standard beard and a "tight" beard respectively.
Figure 2B:
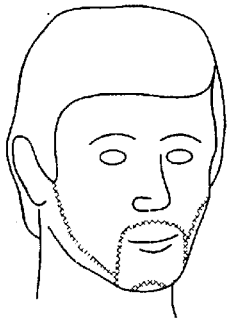

FIG. 1 is a perspective view of a razor assembly configuration in accordance with the present invention. The assembly includes a razor head 26 mounted to a handle 28 in a fixed or pivoting relationship. First and second razor blade assemblies 22A, 22B are mounted to the head 26. The blade assemblies 22A, 22B are positioned on the head 26 such that the longitudinal axes 41A, 41B of the razor blades 39 mounted thereto are substantially aligned. The first and second blade assemblies 22A, 22B are further spaced apart by a lateral gap 24, which way be fixed, or adjustable, in width. In this manner, a user may create a "tight" beard appearance as shown in FIG. 2B by applying the first and second blade assemblies to each side of the beard line simultaneously; thereby achieving a narrow and uniform beard line.

Figure 3A:
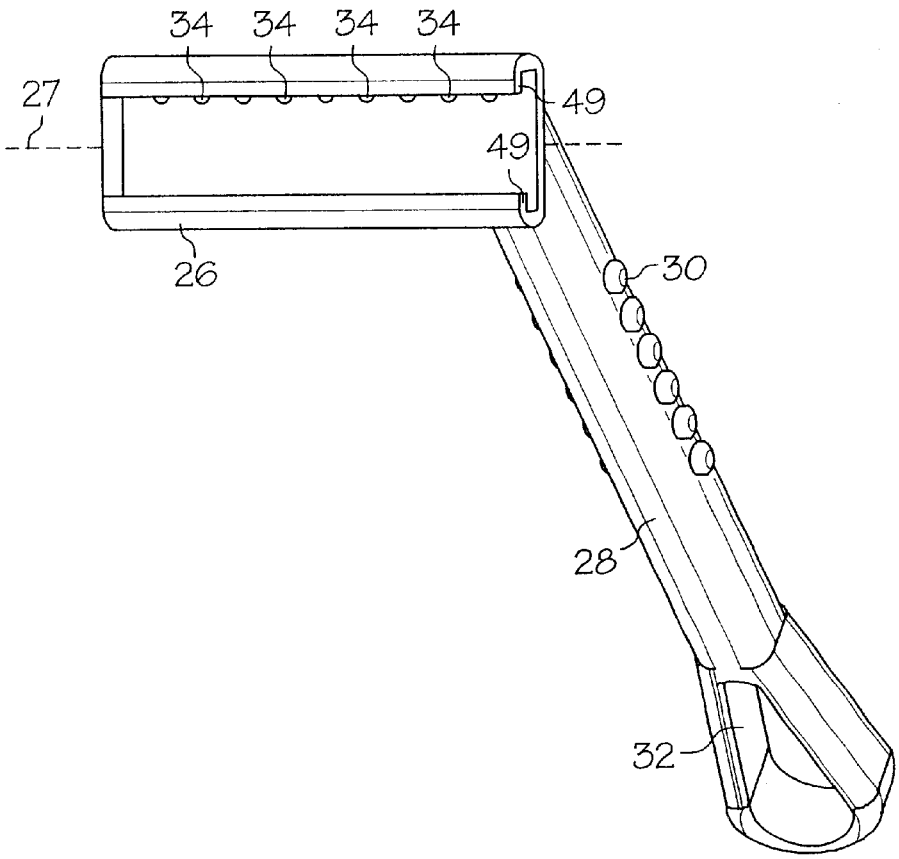
FIG. 3A is a perspective view of a razor head and handle assembly in accordance with the present invention.

FIG. 3A is a perspective view of the head assembly 26 and handle 28. The handle 28 includes grip tabs 30 and an aperture 32. The grip tabs 30 may comprise raised regions which collectively provide a gripping surface, as shown. The aperture 32 is adapted for hanging the razor assembly by its handle 28, for example by a hook mounted to a wall or vanity. The head 26 is preferably fixed to the handle 28 by conventional means in a fixed or pivotal relationship. The head 26 is preferably rectangular in shape and includes upper and lower lips 49 extending along its primary axis 27. Recesses 34 are adapted for mating with a tab on each blade assembly for discrete positioning of the blade assemblies 22A, 22B with respect to each other, and with respect to the head 26 along its primary axis 27.

Figure 3B:
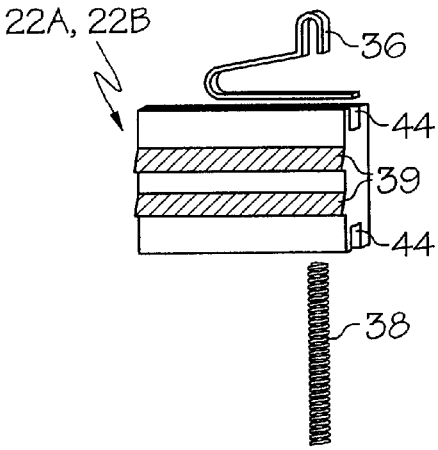
FIG. 3B is a perspective view of a razor blade assembly in accordance with the present invention.
Figure 4A:
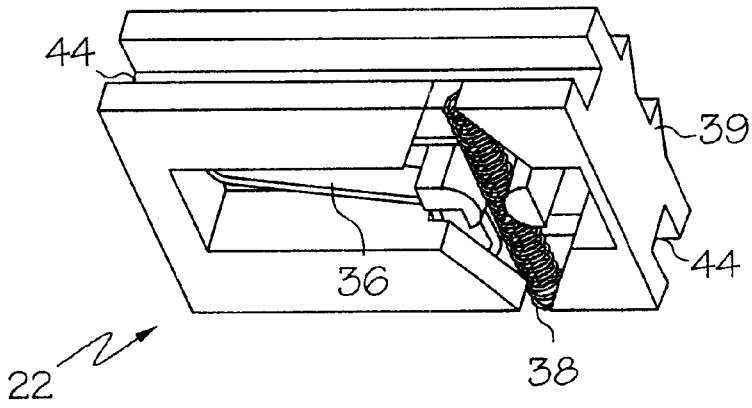
FIGS. 4A, 4B, 4C, 4D, and 4E are a plan view (perspective, back, top, front, and side views respectively) of a razor blade assembly in accordance with the present invention.
Figure 4B:
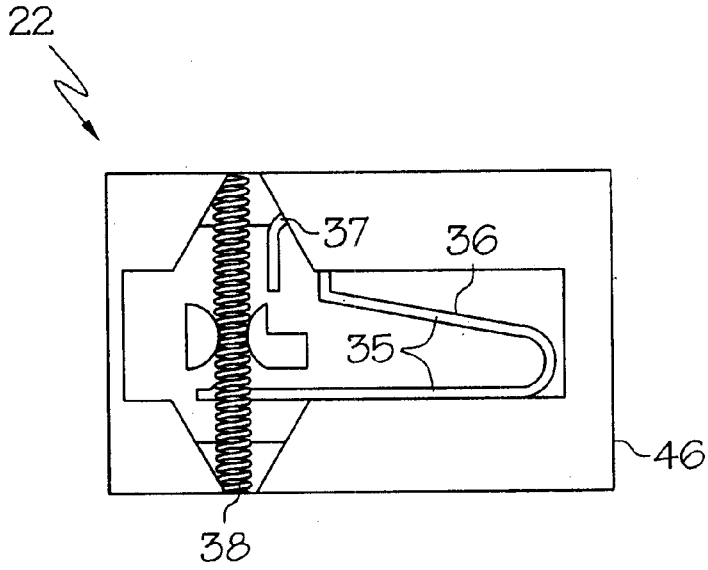
Figure 4C:
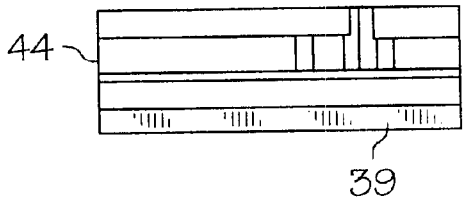
Figure 4D:
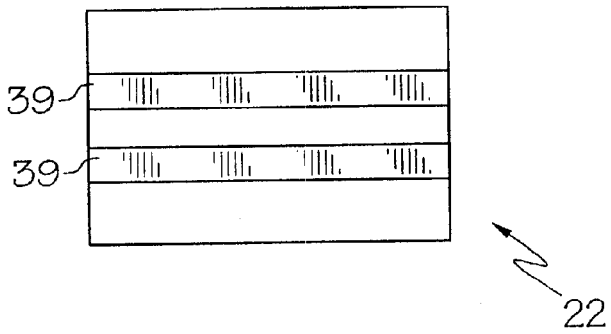
Figure 4E:
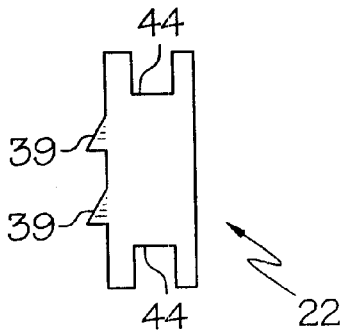

FIG. 3B is an exploded perspective view of a blade assembly 22A, 22B. Each blade assembly preferably includes first and second razor blades 39, a positioning tab 36, and a spring 38. The blade assemblies 22A, 22B are adapted to mount at a side edge of the head 26 such that the blade assembly grooves 44 mate with the lip 49 on the head, and such that the blade assembly is slidable relative thereto. Alternatively, the blade assemblies 22A, 22B may be mounted to a front face of the head, with retaining members which, once mounted to the head, are slidable relative to the head along its primary axis 27. As each blade assembly 22A, 22B slides across the head 26, the locking tab 36 is spring-biased to incrementally interface with the recesses 34, thereby securing the blade assembly in place for a shaving procedure.

FIGS. 4A–4E collectively are a plan view of the blade assembly, showing perspective, back, top, front, and side views respectively thereof. As shown in the rear view of FIG. 4B, the tab spring 38 urges the positioning tab 36 in an outward direction toward the head recesses 34 (see FIG.3A). The positioning tab 36 is seated in a rear portion of the blade assembly body 46 such that tab portion 37 is outwardly biased by an arm portion 35. When the blade assembly 22 slides relative to the head, the tab 37 is continuously biased against the recesses 34, and incrementally engages each recess, such that discrete blade positions can be obtained.

Figure 5A:
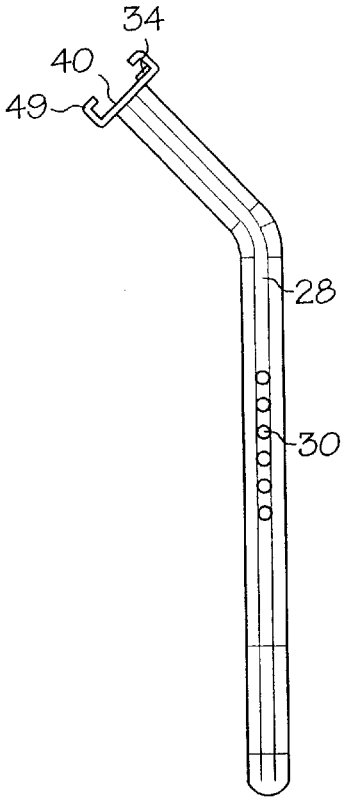
FIGS. 5A, 5B, 5C and 5D are a plan view (side, front, and top views respectively) of a handle and head assembly in accordance with the present invention.
Figure 5B:
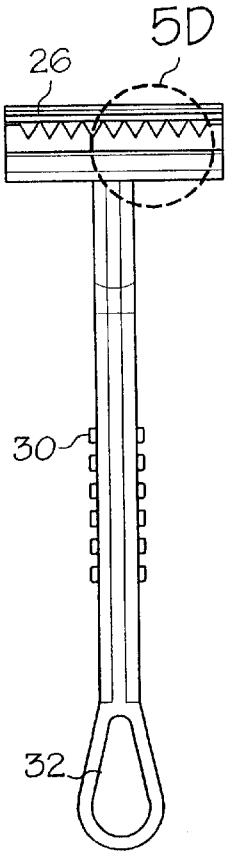
Figure 5C:
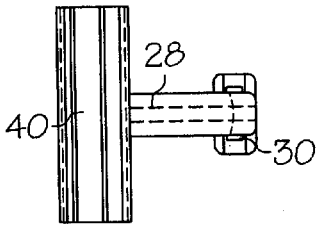
Figure 5D:
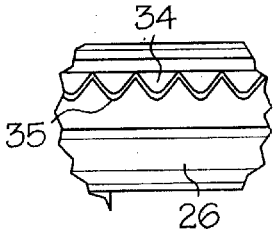

FIGS. 5A, 5B, and 5C collectively are a plan view of the head 26 and handle 28 assemblies, showing front, side, and top views thereof. The lip 49 and recess 34 configurations are visible in the various views. FIG. 5B is an expanded view of the face of the head 26, illustrating an exemplary geometry of the recesses 34. Each recess 34 has a rounded edge 35 to allow for smooth movement of the positioning tab between recesses 34. The recesses 34 may be located along the back wall 40 of the head 26 housing as shown, or may optionally be located on either, or both, inner surfaces of the lips 49.

Figure 6:
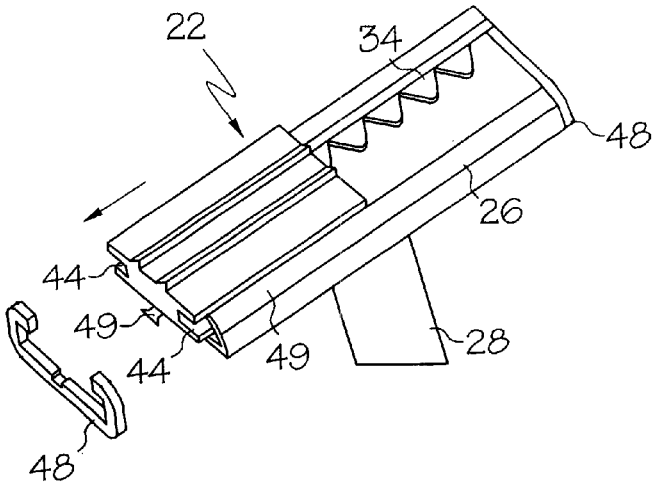
FIG. 6 is a perspective view illustrating the mechanical communication between the head and razor blade assembly in accordance with the present invention.

FIG. 6 is a perspective view illustrating the slidable relationship of the blade assembly 22A with respect to the head 26. This view further includes optional end caps 48 for retaining the removable blade assemblies 22A in the head 26. The caps 48 may include a locking member 49 for securing the cap 48 at an end of the head 26.

In a preferred embodiment, each blade-head assembly may have a width of approximately one-half inch. Each assembly may comprise a single razor blade edge or multiple parallel razor blade edges, for example three. The incremental lateral position settings are spaced such that the blade assemblies optionally may be positioned adjacent one another, without a gap, as in a conventional razor, or positioned to be spaced approximately three-quarters of an inch when fully extended. The recesses are preferably positioned at one-eighth inch increments, and the blade assemblies are preferably independently movable relative to each other within the head 26. Such a configuration allows a user the largest degree of freedom for grooming a uniform width of facial hair in any desired design pattern. Following grooming of the beard region, the blades can be adjusted to be positioned adjacent each other, without a gap, for grooming the remainder of the unwanted facial hair.

An alternative embodiment may comprise a stationary end cap 48 at a first end of the unit and a removable snap-on end cap at the other end of the unit used for replacement of the first and second blade assemblies. The positioning of the blade assembly units can be made to be adjustable from either side of the head housing, to allow for full flexibility in shaving configurations. The head, handle, and blade assemblies are preferably formed of durable and lightweight materials, for example plastic and lightweight metals well-adapted for exposure to hot water and shaving cream.

The razor blade assemblies 22A, 22B themselves may each be individually attachable to the head 26, to allow individual replacement of the assemblies. Alternatively, the blade assemblies 22A, 22B may jointly provided, and replaced, along with the head 26, as in a conventional wet razor. In a fixed-gap configuration, the blade assembles 22A, 22B may be fixed relative to each other and replaceable as a joint unit.

Figure 7A:
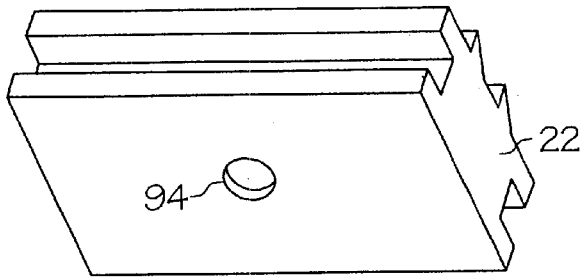
FIGS. 7A–7D are perspective, back, and side views of a blade assembly having an adjustable-width spacer, in accordance with an alternative embodiment of the present invention.
Figure 7B:
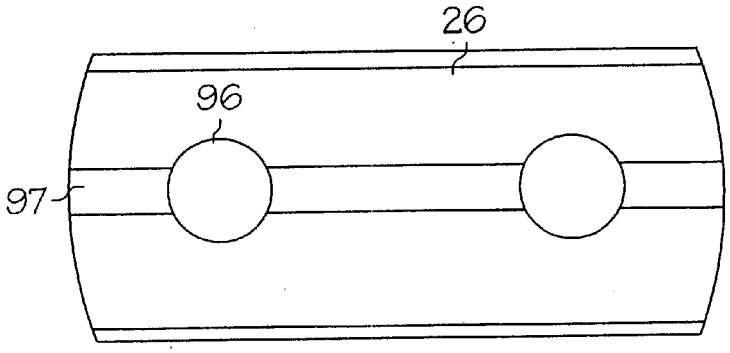
Figure 7C:
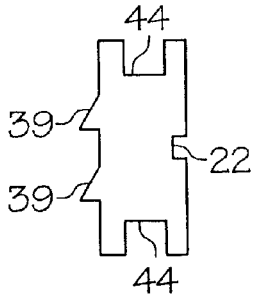
Figure 7D:
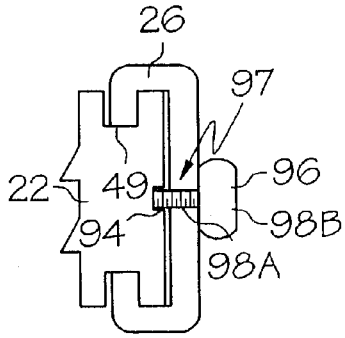

FIGS. 7A–7D are perspective, backs and side views of a blade assembly having an adjustable-width spacer, in accordance with an alternative embodiment of the present invention. Instead of the spring-loaded blade cartridge units described above, this configuration employs blade assemblies 22 that include a single female threaded hole 94 on a rear face as shown in FIGS. 7A and 7C. With reference to FIG. 7B, the head 26 includes a channel 97 adapted to allow a body of a male threaded bolt 96 to freely slide across its length. The resulting configuration is shown in FIG. 7D. The body 98A of the male bolt 96 passes through the channel 97 and mates with the female threads 94 on the blade cartridge 22, such that the cartridge 22 and bolt 96 slide freely in the channel 97. As the bolt 96 is tightened, the cartridge 22 becomes fixed in place. Assuming that two cartridges 22 are mounted to the head 26, the gap width between the cartridges can be variably adjusted by a user.

In alternative embodiments, one or both of the blade assemblies may be fixed relative to the head. In an embodiment where both are fixed, the gap between them is likewise fixed. An exemplary fixed-gap embodiment is illustrated in FIGS. 9A–9C. The embodiments each include a handle 28 having an integral hanging aperture 32. The top portion of the handle is divided into left and right necks 90A, 90B, which extend generally in a "V" shape, as shown. Each neck portion 90A, 90B includes blade attachment means, for example for receiving a fixed or pivoting blade assembly 92A, 92B. The blade assemblies 92A, 92B are spaced apart by a fixed spacer distance 24, for example ⅛" in FIG. 9A, ¼" in FIG. 9B, and ⅜" in FIG. 9C. This configuration is applicable to, for example, a disposable shaving unit manufactured to provide a consumer with a range of options in fixed-spacing widths. In alternative embodiments, the entire handle 28 and left and right blade assemblies 92A, 92B may be provided as a single unit, or, optionally, the handle may be adapted to receive disposable individual blade assemblies.

Figure 9:
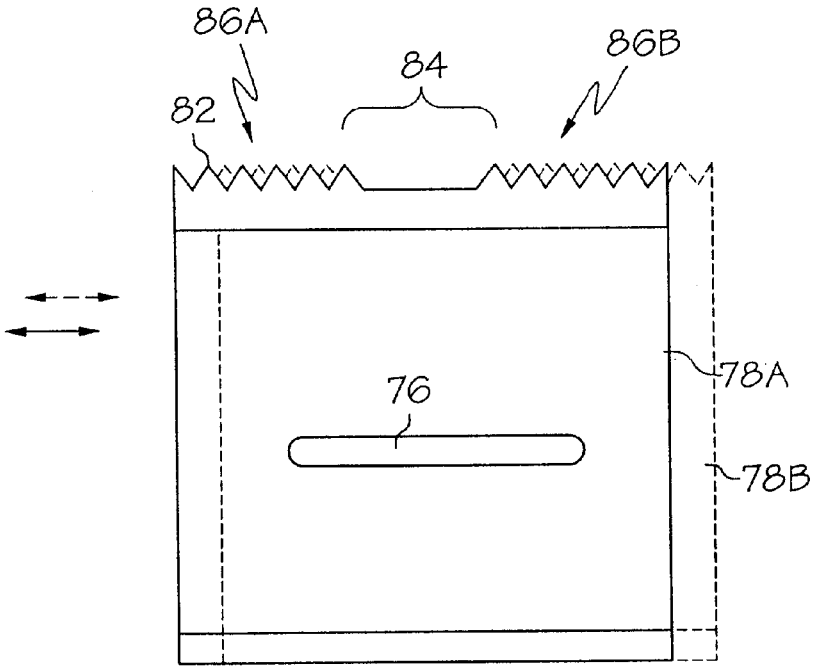
FIG. 9 is a top view of an electric razor blade having a spacer, in accordance with an alternative embodiment of the present invention.
Figure 8A:
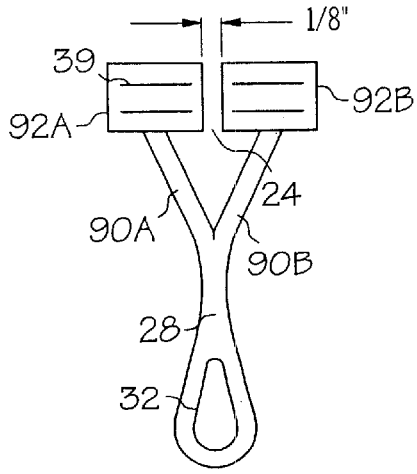
FIGS. 8A–8C are illustrations of shavers having split handles and blade assemblies having fixed-width spacers, in accordance with the present invention.
Figure 8B:
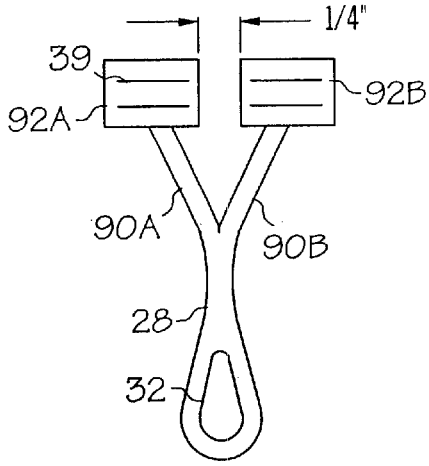
Figure 8C:
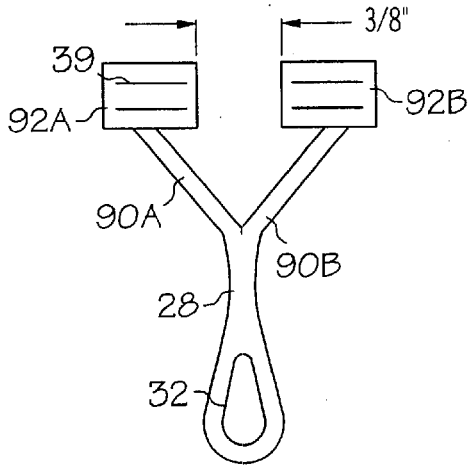

In another embodiment, the present invention is directed to a blade configuration having a lateral spacer for use with an electric shaver. As shown in FIG. 9, a electric shaver includes first and second blades 78A, 78B which undergo rapid side-to-side lateral motion. A small motor drives one, or both, of the blades via pocket 76. The blades include angled teeth 82 having sharp edges. As the blades are swept across a user's face, any facial hair positioned between the teeth 82, become cut by the blades 78A, 78B.

In accordance with the present invention, the blades 78A, 78B shown in FIG. 9 are modified to include a spacer portion 84 absent teeth 82, between first and second teeth portions 86A, 86B. In this manner, any hairs directed between the vibrating teeth 82 in the teeth portions 86A, 86B are cut, while hairs directed through the spacer portion 84 are retained. In this manner, a beard of uniform width can be attained with relative ease. A variety of interchangeable blades 78A, 78B having spacer portions 84 of various gap widths may be provided to allow for adjustability in beard width.

While this invention has been particularly shown and described with reference to preferred embodiments thereof, it will be understood by those skilled in the art that various changes in form and in detail may be made herein without departing from the spirit and scope of the invention as defined by the appended claims.

I claim:

1. A razor head assembly comprising:

a razor head supportable of razor blade assemblies; and first and second razor blade assemblies mountable to said head, said razor blade assemblies each including a razor blade having a longitudinal axis along its length; said first and second blade assemblies being mountable such that their longitudinal axes are substantially aligned and such that their razor blades are laterally spaced apart by a gap;

wherein at least one of said first and second razor blade assemblies is independently positionable relative to said head along said longitudinal axis for adjusting the width of the gap.

2. The razor head assembly of claim 1 wherein the at least one of the first and second blade assemblies is slidable relative to said head along said longitudinal axis.

3. The razor head assembly of claim 2 further including a tab for discrete positioning of the at least one slidable first and second blade assemblies.

4. The razor head assembly of claim 3 wherein the tab comprises a spring-loaded arm mounted to the at least one slidable first and second blade assemblies and wherein the tab is adapted to interface with recesses on the head for discrete positioning thereof.

5. The razor head assembly of claim 1 wherein the head comprises a channel for slidably receiving at least one of the first and second razor blade assemblies, and further including means for fixing the at least one blade assembly over a range of positions in the channel.

6. The razor head assembly of claim 5 wherein the means for fixing comprises a mating threaded male bolt and threaded female hole.

7. The razor head assembly of claim 1 wherein said first and second razor blade assemblies are mounted in a fixed position relative to said head.

8. The razor head assembly of claim 1 wherein said head is mounted to a handle at a proximal end of said handle and wherein said handle further includes a hanging aperture at a distal end.

9. The razor head assembly of claim 8 wherein the head and handle are pivotally coupled.

10. The razor head assembly of claim 1 wherein the first and second razor blade assemblies each include multiple razor blades having parallel and spaced-apart longitudinal axes.

11. A shaving apparatus for grooming a beard of uniform width comprising:

a first trimming means for trimming facial hair; and a second trimming means for trimming facial hair, said second trimming means being in alignment with said first trimming means and spaced apart from said first trimming means by a lateral gap, such that said first and second trimming means remove facial hair directed into the path of the first and second trimming means, and such that facial hair directed into the path of the lateral gap is retained;

wherein at least one of said first and second trimming means are independently positionable relative to the other of the trimming means for adjusting the width of the gap.

12. The shaving apparatus of claim 11 wherein the first and second trimming means comprise razor blades.

13. The shaving apparatus of claim 12 wherein the first and second trimming means comprise razor blade assemblies adapted to slide in a lateral direction relative to each other for adjusting the lateral gap width.

14. The shaving apparatus of claim 11 wherein the first and second trimming means comprise first and second portions of an electric shaver blade, the blade including a row of teeth extending in the lateral direction, the row of teeth including first and second teeth portions, separated by a gap portion.

15. A razor assembly comprising:

a handle supportable of razor blade assemblies, the handle having a longitudinal axis; and first and second razor blade assemblies mountable to said handle, said razor blade assemblies each including a razor blade having a longitudinal axis; said first and second blade assemblies being mountable such that such that their razor blades are laterally spaced apart by a gap, and such that their longitudinal axes are aligned and perpendicular to the longitudinal axis of the handle.

16. The razor assembly of claim 15 wherein the gap is of a width that is fixed.

17. The razor assembly of claim 15 wherein the handle is split over a portion of its length into left and right portions, each of the left and right portions adapted for mounting a corresponding blade assembly.

18. The razor assembly of claim 15 wherein at least one of said first and second razor blade assemblies is independently positionable relative to the other of the first and second razor blade assemblies along the longitudinal axes of the razor blades for adjusting the width of the gap.

19. The razor assembly of claim 15 wherein at least one of the first and second razor blade assemblies is slidable relative to the other of the first and second razor blade assemblies along the longitudinal axes of the razor blades.

20. The razor assembly of claim 19 further including a tab for discrete positioning of the at least one slidable first and second razor blade assemblies.

* * * * *

UNITED STATES PATENT AND TRADEMARK OFFICE

CERTIFICATE OF CORRECTION

PATENT NO. : 6,418,623 B1
DATED : July 16, 2002
INVENTOR(S) : Michael A. Marcarelli It is certified that error appears in the above-identified patent and that said Letters Patent is hereby corrected as shown below:

Column 6,
Line 9, insert -- , the first trimming means extending in a longitudinal direction along a first longitudinal axis -- after "facial hair".
Line 11, after "a second trimming means for trimming facial hair", delete "said second trimming means in alignment with said first trimming means" and insert -- the second trimming means extending in a longitudinal direction along a second longitudinal axis, the second longitudinal axis of said second trimming means being substantially collinear with said first longitudinal axis of said first trimming means, the second trimming means being --.
Line 42, delete "such that".
Line 43, delete "aligned" and insert -- substantially collinear --.

Signed and Sealed this

Twenty-eighth Day of October, 2003

JAMES E. ROGAN
*Director of the United States Patent and Trademark Office*